United States Patent [19]

Berg et al.

[11] Patent Number: 5,027,935

[45] Date of Patent: Jul. 2, 1991

[54] APPARATUS AND METHOD FOR CONSERVING POWER IN AN ELECTRONIC COIN CHUTE

[75] Inventors: Eilert J. Berg, Ada, Mich.; Byron D. Bowles; James D. York, both of Indianapolis, Ind.

[73] Assignee: AT&T Bell Laboratories, Murray Hill, N.J.

[21] Appl. No.: 457,005

[22] Filed: Dec. 26, 1989

[51] Int. Cl.[5] ..... G07D 5/08

[52] U.S. Cl. ..... 194/318; 379/146

[58] Field of Search ..... 194/317, 318, 319; 379/146, 147, 148

[56] References Cited

U.S. PATENT DOCUMENTS

| | | | |
|---|---|---|---|
| 3,870,137 | 3/1975 | Fougere | 194/317 |
| 4,279,020 | 7/1981 | Christian et al. | 364/900 |
| 4,361,731 | 11/1982 | Smoot | 179/6.3 |
| 4,488,006 | 12/1984 | Essig et al. | 179/81 |
| 4,612,418 | 9/1986 | Takeda et al. | 179/81 |
| 4,848,556 | 7/1989 | Shah et al. | 194/212 |

FOREIGN PATENT DOCUMENTS

| | | | |
|---|---|---|---|
| 2078466 | 1/1982 | United Kingdom . | |
| 82/02786 | 8/1982 | World Int. Prop. O. | 194/317 |

OTHER PUBLICATIONS

Application Ser. No. 368,619 filed 6/20/89.

*Primary Examiner*—F. J. Bartuska
*Attorney, Agent, or Firm*—Michael A. Morra

[57] ABSTRACT

An electronic coin chute (ECC) for use in a public telephone station has only a small amount of electrical power available from the telephone line when examining coins for authenticity and denomination. To conserve power during the examination process, a plurality of coin quality sensors are used, each designed to use minimum power. Each sensor generates an oscillating magnetic field that interacts with the coin as it gravitates through the coin chute. By monitoring the output electrical signal from each coin quality sensor, the microprocessor is able to determine when the coin has moved beyond its field and, in response, power is removed from that sensor and applied to the next. After the coin's qualities have been measured, they are compared with stored acceptance limits. Power is removed from the last coin quality sensor and applied to a coin routing apparatus to guide accepable coins into a collection box.

7 Claims, 9 Drawing Sheets

APPARATUS AND METHOD FOR CONSERVING POWER IN AN ELECTRONIC COIN CHUTE

TECHNICAL FIELD

This invention relates generally to electronic coin chutes, and more particularly to a low power apparatus for validating and accepting coins.

BACKGROUND OF THE INVENTION

Telephone station equipment has traditionally relied on receiving its power from a telephone central office which provides a supply of voltage whose magnitude, source impedance, and reliability are known and controllable. The advantages of such an arrangement are well known in view of periodic commercial power outages, during which time telephone communications, particularly emergency services, have not been interrupted for lack of power. A disadvantage of this arrangement, however, has been the fact that the maximum power that can be relied on is relatively small due to the fact that the wires connecting the telephone to the central office are resistive, and may be quite long (many miles). Public coin telephone equipment is no exception to the tradition of receiving its power from a central office and must operate reliably at low power levels.

Mechanical coin chutes have been used for years in coin telephone equipment. They perform the job of authenticating and accepting coins without electrical power so that all of the available power is at the disposal of the circuits used for signaling and speech. Unfortunately, mechanical coin chutes are bulky, expensive, and account for at least 50% of the problems associated with the equipment to which they are attached. Recently, electronic means have been used to simplify coin chute design, improve reliability and reduce cost. However, electronic coin chutes (ECCs) consume power in carrying out their job of authenticating and accepting coins of various denominations, and it is not desirable to introduce batteries or commercial power (115 VAC) into coin telephone equipment for a variety of reasons.

U.S. Pat. No. 4,848,556 discloses a Low Power Coin Discrimination Apparatus which uses a battery to power a piezoelectric transducer that measures the mass of the coin, and a photoelectric sensor that measures its area. The discriminator automatically returns to a lower power state once it has completed the discrimination process. However, since the available current is severely limited, powering such discrimination apparatus may not be possible—particularly when relatively large amounts of current are required. Indeed, a single light emitting diode may need the entire available current to be effective. Further, since it is neither convenient nor cost effective to use batteries when powering coin telephone equipment, the techniques disclosed in the above patent are not directly applicable to situations in which peak power is severely limited.

British Patent GB 2078466A discloses a microprocessor-controlled, coin-operated telephone that uses a microprocessor to activate and de-activate various parts of a pay phone. This particular telephone, however, relies on the use of light emitting diodes and opto-electronic sensors to monitor the location of coins within the chute. In order to supply the needed power, a rechargeable Nickel-Cadmium battery is used. However, when the use of batteries is permitted, strategies are developed for reducing overall power usage which are not appropriate when minimizing peak power consumption.

One technique for reducing peak power consumption uses energy storage devices that slowly build-up electric charge over a long period of time. Unfortunately, when a telephone station is in an "on-hook" state, only an insignificant amount of current is present on the telephone line. And when the telephone station is in an "off-hook" state, although more current is available, any delay in operation due to the build-up of electric charge is undesirable.

SUMMARY OF THE INVENTION

An electronic coin chute includes one or more coin quality sensors that generate a magnetic field which interacts with a coin while measuring a characteristic of that coin as it travels through the coin chute. Power is applied to the coin quality sensor just prior to the time that the coin enters its magnetic field. The coin quality sensor provides an output electrical signal that varies in accordance with the interaction between the coin and the magnetic field. In response to the output signal from the coin quality sensor, means are provided for removing power from the coin quality sensor subsequent to the time when the interaction between the coin and the magnetic field is at its maximum.

In an illustrative embodiment of the invention, a pair of coils are positioned on opposite sides of a path that the coin must travel as it gravitates through the ECC. These coils are part of an oscillator circuit used in the coin quality sensor. The frequency of the oscillator changes when a coin passes through the magnetic field of its coils. The interaction between the coin and the magnetic field is detected by measuring the time duration between zero crossings of the oscillator. This interaction is indicative of a particular quality (such as composition or size) of the coin. It is also indicative of the proximity of the coin to the sensor. Electrical power is advantageously conserved by shutting down power consuming devices after they have completed their interaction with the coin and before another power consuming device is turned on.

In the illustrative embodiment of the invention, coin routing apparatus is used to guide acceptable coins into a collection box and all others into a return chute. The coin routing apparatus comprises a solenoid that is driven in two stages. During the first stage voltage is applied in a manner that allows current in the solenoid to build up quickly so that it will be operated in a very brief time interval. Thereafter, current is limited to an amount that will maintain the solenoid in its operated condition, but only consume a minimum amount of power.

These and other features of the invention will be more fully understood when reference is made to the detailed description and associated drawing.

DETAILED DESCRIPTION

GENERAL

Figure 1:
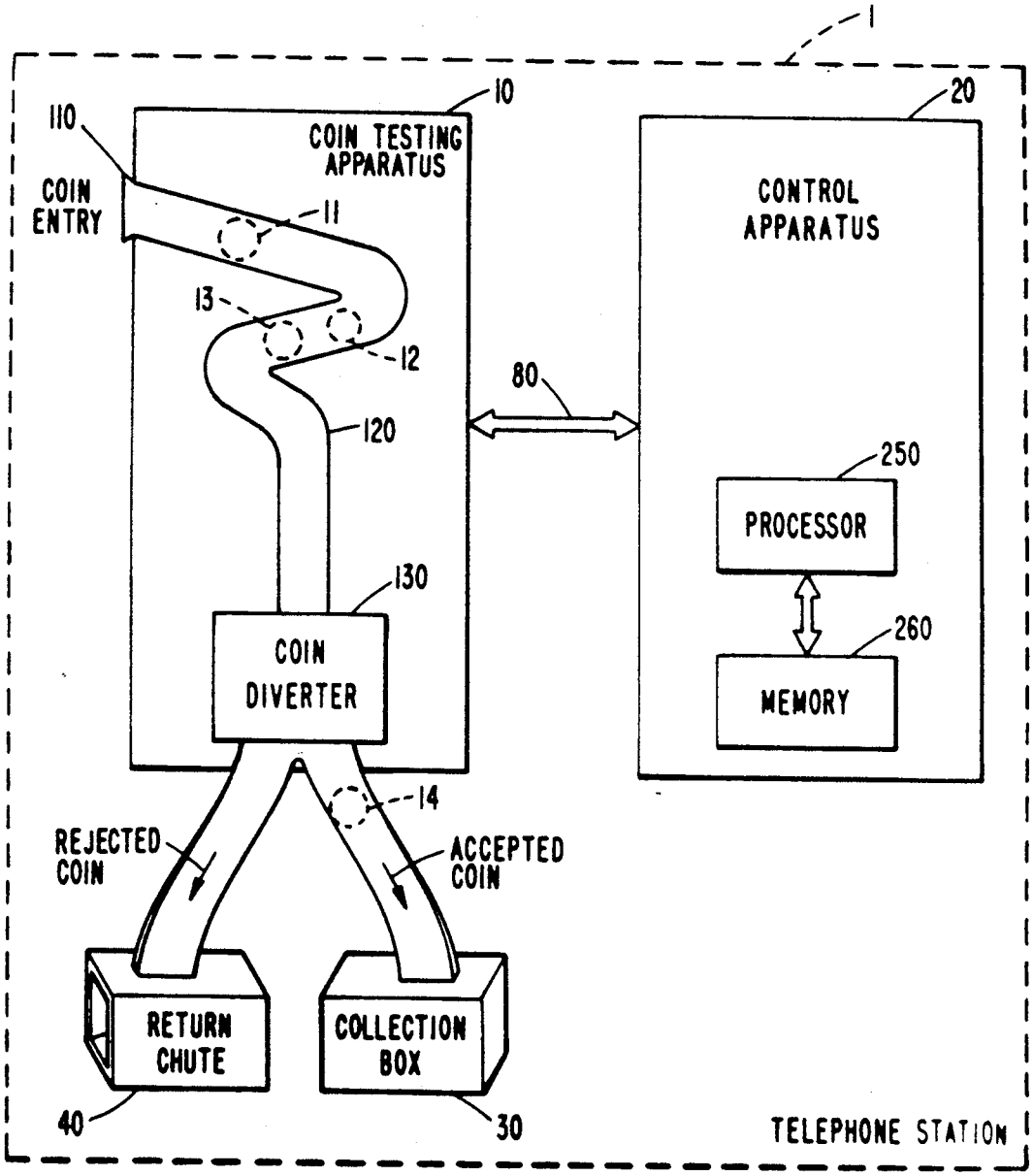
FIG. 1 illustrates the functional elements typically present in electronic coin validation equipment such as in a telephone station.
Figure 2:
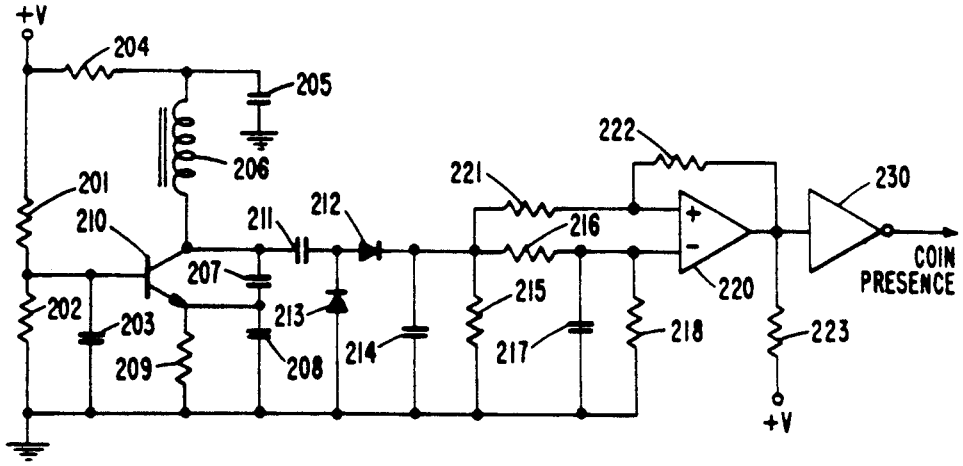
FIG. 2 discloses a schematic drawing of an oscillator circuit used in the present invention to detect the presence of a coin.
Figure 3:
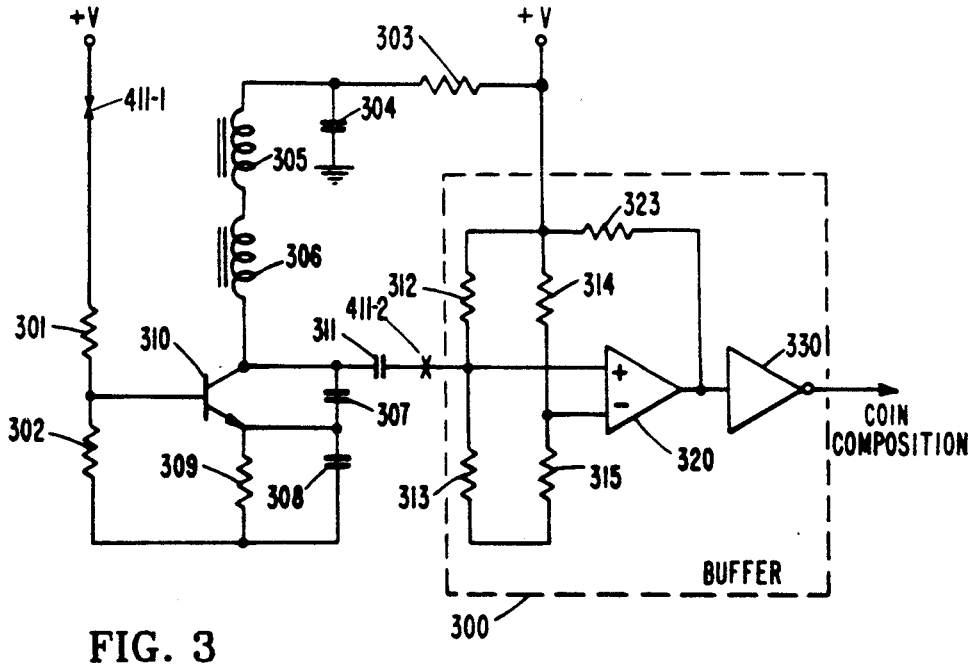
FIG. 3 discloses a schematic drawing of an oscillator circuit used in the present invention to determine coin composition.

The electronic coin validation equipment of FIG. 1, such as contained within telephone station 1, includes coin testing apparatus 10 and control apparatus 20. In particular, the latter includes processor 250 which controls virtually all operations of the equipment in accordance with a program stored in associated memory 260. Memory 260 may either be part of processor 210 or a separate device. Control apparatus 20 further includes one or more oscillator circuits, such as shown in FIG. 2 and 3, plus a drive circuit for operating coin routing apparatus (coin diverter 130). Processor 250 monitors the frequency of these oscillator circuits and other input signals in accordance with a program stored in memory 260. In response, the processor 250 causes the coin diverter 130 to be activated or de-activated via the drive circuit.

In connection with FIG. 1, coin presence detector 11 determines when a coin has been inserted into coin entry 110. Detector 11 comprises a coil which is part of an oscillator circuit contained within control apparatus 20. Coin quality sensors 12 and 13 each comprise a pair of coils that are part of a second oscillator circuit contained within control apparatus 20. As discussed previously, coin quality sensors 12 and 13 are used in identifying the type of coin traversing coin path 120. Finally, after a coin has been accepted, it is routed to collection box 30. Coin collected detector 14 is positioned to monitor coins entering the collection box. Detector 14 is substantially identical to detector 11 in that it comprises a single coil which is part of an oscillator circuit contained within control apparatus 20. Coin presence is determined by measuring changes in the amplitude of the signal generated by the associated oscillator circuit, whereas coin quality is determined by measuring changes in the frequency of that signal. Additionally, the frequency of the oscillator associated with coin collected detector 14 is monitored to determine when the collection box 30 is full. When a coin is unable to fully enter the collection box, it will remain in the vicinity of detector 14 and cause a permanent frequency shift in the associated oscillator. This event can be used to turn on a light to indicate that the equipment is no longer functional, transmit a signal to a remote location and/or cause the coin diverter 130 to route all inserted coins to return chute 40. These functions, and variations thereof, are matters of design choice.

Electronic coin processing offers a number of advantages over mechanical devices. These advantages are primarily attributable to the availability of small, inexpensive microprocessors and associated memories. Such advantages include improved reliability, lower cost and weight, programmable coin validation parameters, and generally simpler construction. Electrical and optical transducers measure various properties of a coin as it travels along a generally unobstructed path toward either a return chute or a collection box.

Coins of various denominations are inserted into entry 110 which is sized to admit only those coins having a predetermined maximum diameter and/or thickness. Such preliminary screening is, illustratively, the only mechanical measurement performed on the coin. The remaining measurements are performed electrically, and for the purpose of determining the identity of the coin. Once identified, the coin is either delivered to collection box 30 or returned to the depositor through return chute 40 because it is not a member of the allowed set.

Control apparatus 20 exchanges electrical signals with coin testing apparatus 10 during a validation operation which generally takes less than one second to complete. The controller senses the presence of a coin as it rolls along a continuously descending ramp at a speed determined by the slope of the ramp and the parameters of the coin. The parameters of the coin are determined by pairs of coils placed along the coin path. Each pair of coils is intended to measure a single property of the coin, and each member of the coil-pair is located on an opposite side of the coin path facing the other member of the coil-pair so that the coin must pass between them. The coil-pair is generally part of an oscillator circuit whose frequency, phase or amplitude is modified by the presence of the coin. Such variations are caused by changes in inductance. From electromagnetic theory, a mathematical expression can be derived to determine the fractional change in inductance $\Delta L/L$ of a circular coil when a coin is placed along its axis:

$$\Delta L/L = \frac{\pi(r_c r_\epsilon)^3[1 - \exp(-t/\delta)]}{2(1 - z^2/r_\epsilon^2)^3[\ln(8r_\epsilon/a) - 2]}$$

where:

$r_c$ = radius of the coin
$r_\epsilon$ = radius of the coil
$t$ = thickness of the coin
$\delta$ = skin depth in material of coin
$z$ = coin-coil spacing (along axes)
$a$ = wire radius and $$\delta = \frac{1}{\sqrt{f\pi\mu\sigma}}$$

where:

$f$ = operating frequency of coil
$\mu$ = permeability of coin
$\sigma$ = conductivity of coin As a practical matter, coil size depends on the property of the coin that is being tested. For example, to test the composition of a coin, the coil size has to be small enough to be covered entirely by all coins. Also, sensitivity is greatest when the coil-coin gap is smallest. In this case, limitations are due to the thickness of the thickest coin and the material used in forming the walls of the coin chute. The frequency of operation is related to the particular property being measured. High frequencies do not penetrate the material of the coin very deeply. The skin depth at 200 kHz in 70–30 Cu-Ni alloy—used in United States coins—is 0.025 inches. The thickness of the cladding on a United States 25-cent coin is 0.011 inches. Although frequencies of 200 kHz and higher are not affected by the bulk properties of the coin (thickness and composition), they can be used for diameter measurement. For composition testing, a lower frequency is desirable so that the electromagnetic field can penetrate the bulk of the coin. A frequency of 20 kHz has a skin depth of 0.08 inches in 70–30 Cu-Ni alloy. U.S. Pat. No. 3,870,137 discusses the use of two oscillating electromagnetic fields, operating at substantially different frequencies, for examining the acceptability of coins. Typically, size and composition measurements are sufficient to uniquely identify a coin. Obviously, other properties exist such as weight, thickness, engraving marks, etc., which could be considered if the level of coin fraud exceeds the cost of implementation or if several coins in the allowed set have great similarity. Once the coin has traversed path 120 within coin testing apparatus 10, control apparatus 20 decides whether to accept or reject the coin. Coin diverter 130 must be activated to deflect coins into collection box 30. This provides fail-safe operation so that coins will not be taken from the user by default.

Coin Chute Operation

FIG. 2 discloses the circuit used in connection with detectors 11 and 14 of FIG. 1, for detecting the presence of a coin. As was previously noted, detector 11 provides an indication that a coin has entered the chute while detector 14 indicates that the coin has been collected. The coin presence circuit comprises a modified Colpitts oscillator. Resistors 201 and 202 provide DC bias for transistor 210 while capacitor 203 provides an AC ground at the transistor 210 base. Resistor 204 and capacitor 205 are used to filter the power supply voltage. Inductor (coil) 206 cooperates with capacitors 207 and 208 in setting the frequency of oscillation. Emitter resistor 209 limits the current through transistor 210. Capacitor 211 couples the output of the oscillator to a voltage doubler comprising diodes 212, 213 and capacitor 214. Resistor 215 supplies a discharge path for capacitor 214 having a short time constant. A longer time constant is provided by components 216–218. Comparator 220 compares the relative amplitudes of its two AC input signals. The longer time constant signal, into its inverting input, serves as a reference signal against which the shorter time constant signal is compared. The presence of a coin in the vicinity of coil 206 causes an increase in frequency of the signal out of transistor 210 but a decrease in its amplitude. Therefore, the output of comparator 220 goes low when a coin transits past coil 206. Resistors 221 and 222 provide a feedback path for regulating the gain of comparator 220. Component 223 is a pull-up resistor for comparator 220 which has an open-collector output. Schmitt trigger 230 is a buffer circuit between the comparator and processor 250 shown in FIG. 1.

FIG. 3 discloses a circuit used in measuring coin composition, and is used in connection with sensor 12 of FIG. 1. An identical design is used in measuring coin size in connection with sensor 13 of FIG. 1. The coin composition circuit of FIG. 3 comprises a modified Colpitts oscillator whose frequency is chosen in accordance with the quality to be measured as discussed above and in U.S. Pat. No. 3,870,137. Resistors 301 and 302 provide DC bias for transistor 310. Resistor 303 and capacitor 304 are used to filter the power supply voltage. Inductors (coils) 305 and 306 cooperate with capacitors 307 and 308 in setting the frequency of oscillation. It is noted that these coils are placed on opposite sides of the coin path so that the coin must pass between them (and thereby alter the oscillator's frequency) as it gravitates through the ECC. Emitter resistor 309 limits the current through transistor 310. Capacitor 311 couples the output of the oscillator to comparator 320 which converts a sinusoidal signal into a square wave. Resistors 312–315 operate to provide DC bias voltages to the input leads of comparator 320. The inverting input is biased at a slightly higher positive voltage than the non-inverting input. Component 323 is a pull-up resistor for comparator 320 which has an open-collector output. Schmitt trigger 330 is a buffer circuit between the comparator and a counter which is discussed in connection with FIG. 4. Components 411-1 and 411-2 are Silicon Gate CMOS switches having low ON resistances and low OFF leakage currents. They are associated with the coin composition oscillator and are simultaneously operated. Activation of switch 411-1 causes voltage +V to be applied to transistor 310 which commences oscillating. Buffer 300 services various circuits including: coin composition, coin size, and coin collected oscillators. Switch 411-2 connects the output of the coin composition oscillator to buffer 300 at the same time power is applied via switch 411-1. A suitable switch is the HC4052 Analog Multiplexer/Demultiplexer which is commercially available from the Motorola Corporation. This device is a double-pole, four-position switch that simultaneously connects one of four "X" inputs to a common first output, and one of four "Y" inputs to a common second output; where "X" and "Y" represent independent analog signals. This device responds to a pair of binary input signals in selecting one "X" input signal for connection to the first output, and one "Y" input signal for connection to the second output. The selection between the various analog input signals is shown more clearly in the drawing of FIG. 4, particularly by multiplexer 410.

Figure 4:
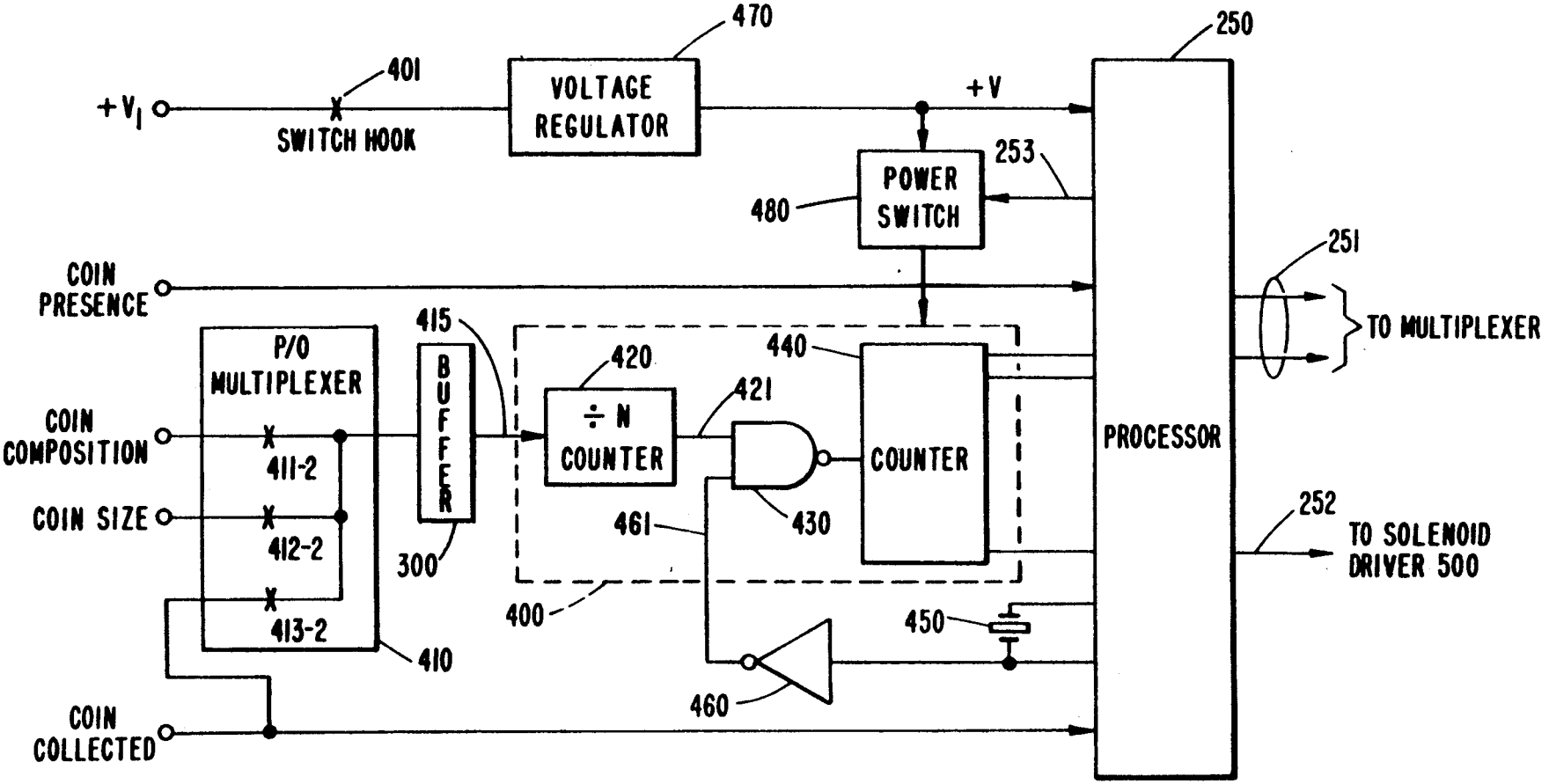
FIG. 4 discloses a block diagram that illustrates the cooperation between the processor and the power control apparatus in accordance with the invention.

FIG. 4 is a block diagram of circuitry within control apparatus 20. In particular, processor 250 is a 4-bit CMOS microcomputer such as the NEC 7508H in which system clock is provided by connecting ceramic resonator 450 across a pair of its input terminals. This resonator operates at 2.46 MHz and delivers a signal to Schmitt trigger 460 which "squares" the signal and delivers it to nand gate 430. In the present embodiment, it is not the frequency change of each coin quality oscillator that is used; rather, an approximation of the reciprocal of this frequency is used. The measurement proceeds by counting the number of pulses from an independent high frequency source that occur between zero crossings of the coin quality oscillator signal. More particularly, gate 430 is enabled by a logic "1" signal on lead 421 to transmit pulses of the 2.46 MHz signal present on lead 461. These pulses are counted in binary counter 440 which delivers an 10-bit wide parallel output signal to processor 250. This parallel output signal provides a measure of the duration between a selected number of zero crossings of the coin quality oscillator signal. Since the frequency of the coin composition oscillator and the frequency of the coin size oscillator are different, and since it is convenient to use a similar number of pulses for each of the coin quality oscillators, counter 420 divides the frequency of the signal on input lead 415 by "N". This corresponds to the number of 2.46 MHz pulses contained in 2 cycles of the composition oscillator, 20 cycles of the size oscillator, or 20 cycles of the coin collected oscillator.

So that the significance of counting high frequency pulses between zero crossings of the coin quality oscillator can be appreciated, a relationship has been established between the number of pulses counted when the coin is away from the the coin quality sensor ($C_{IDLE}$) and the number of pulses counted ($C_V$) when the coin is in the vicinity of the sensor. It has been determined for a particular coin (25-cent, 10-cent, or 5-cent coin) that $C_{IDLE}=MC_V+b$, where M and b are constants. Once these constants are determined for a particular ECC design, they can be stored in memory. Recognizing that slope M is a function of the difference in $C_{IDLE}$ at two different temperatures divided by the difference in $C_V$ at these same temperatures, an algorithm is constructed based on measured differences in $C_{IDLE}$ where one of the measurements is made in a factory at a reference temperature while the other measurement is made at the ambient temperature of the ECC at the time of operation. The following algorithm is used in determining upper and lower limits for each of the quality sensors and for each coin denomination:

$$C_{VU}=k(\Delta C_{IDLE})+C_{VR}+T$$

$$C_{VL}=k(\Delta C_{IDLE})+C_{VR}-T$$

where:

k = a constant of proportionality $\Delta C_{IDLE}$ = the difference between $C_{IDLE}$ at a reference temperature and $C_{IDLE}$ at or about the time of coin authentication;

$C_{VR}=C_V$ as measured at a reference temperature; and

T = tolerance in the upper and lower limits.

Note that different values of k, T and $C_{VR}$ exist for each different coin in the allowed set and for each coin quality sensor. For example, if three coins are in the allowed set and two coin quality sensors are used, then six different values are stored for each k, T and $C_{VR}$. However, only two values of $C_{IDLE}$, measured at the reference temperature, need to be stored—one for each quality oscillator.

Processor 250 carefully controls the application of power during the coin validation process in order to minimize the peak current drawn from the telephone line. Unregulated voltage $V_1$ is available from the telephone line, after rectification, and is delivered to voltage regulator 470 after activation of switchhook 401. A commercially available regulator, such as the ICL76-63A, may be used to provide a regulated source of +V (4.0) volts such as used in the present invention. Power switch 480 comprises a PNP transistor whose emitter terminal is connected to the output of voltage regulator 470, and whose collector terminal delivers +V volts to circuitry shown in block 400 when processor 250 supplies a ground signal over lead 253 to the base terminal of the transistor through a resistor. The flow charts of FIG. 7–11 indicate when power switch 480 is activated. Output leads 251 from processor 250 are used to control the above-described Multiplexer/Demultiplexer switch, a portion of which is shown in multiplexer 410. Each of these leads 251 carries a binary signal thus creating four states (00, 01, 10, 11). One of these states simultaneously activates switch 411-1 (shown in FIG. 3) and switch 411-2 to cause the coin composition oscillator to be powered and its output connected to buffer 300 for the purpose of measuring the time duration between zero crossings of the coin composition oscillator. Similarly, another of these states simultaneously activates switch 412-1 (not shown) and switch 412-2 to cause the coin size oscillator to be powered and its output connected to buffer 300 for the purpose of measuring the time duration between zero crossings of the coin size oscillator. Finally, the coin collected oscillator may be powered and connected to buffer 300 in like manner. After the coin size and composition are measured, processor 250 determines whether correspondence exists between this measured data and stored data for one coin of the allowed set of coins. If so, solenoid driver 500 is activated to divert the coin into the collection box as described below.

Figure 5:
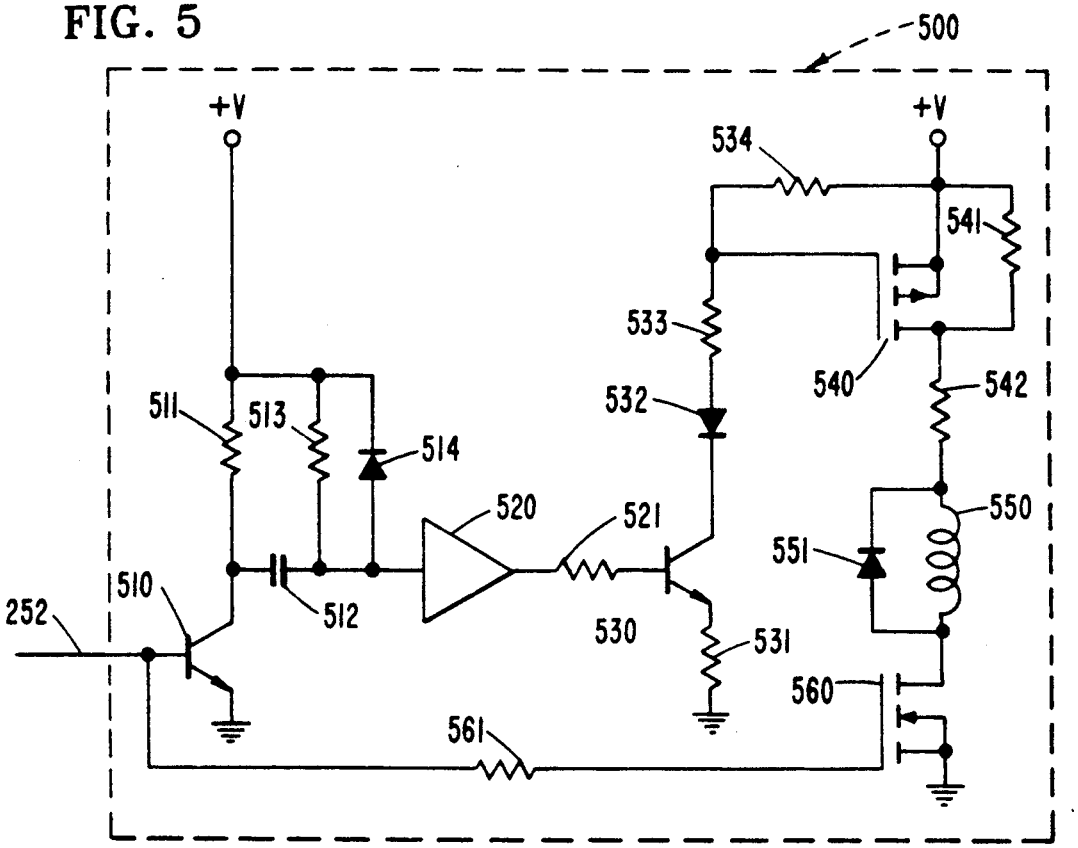
FIG. 5 discloses a schematic drawing of a solenoid driver circuit used in a coin routing apparatus.

FIG. 5 discloses a schematic drawing of solenoid driver 500. A positive voltage on input lead 252 causes activation of the solenoid in the following manner. Components 510–514 cooperate to deliver a short, negative-going pulse to Schmitt trigger 520 which inverts the polarity of the pulse and "squares it up." The duration of the pulse, as determined by the time constant of capacitor 512 and resistor 513, is approximately 100 milliseconds. Components 531–534 invert and buffer the output pulse from Schmitt trigger 520. P-channel field effect transistor (FET) 540 now turns on when a low voltage is applied to its gate. FET 540 has a low ON resistance. Resistor 542 limits the maximum current that can flow through solenoid 550. N-channel FET 560 is turned ON at this time because the voltage on lead 252 is high. Solenoid 550 comprises an inductor whose current builds up linearly. After 100 milliseconds have elapsed, the solenoid is operated and the output pulse from Schmitt trigger 520 terminates—thus turning off FET 540; however, resistor 541 and FET 560 continue delivering enough current to keep solenoid 550 operated for another 100 milliseconds. At this time the coin has moved into the collection box, an event detected by the coin collected detector, and processor 250 lowers the voltage on lead 252 and releases the solenoid. If for some reason the coin collected detector does not indicate that the coin has passed-by, the solenoid will be released when timer $T_2$ expires. Diode 551 prevents high voltages from being generated by solenoid 550 when its current is suddenly cut off.

Sequence of Operations

Figure 6:
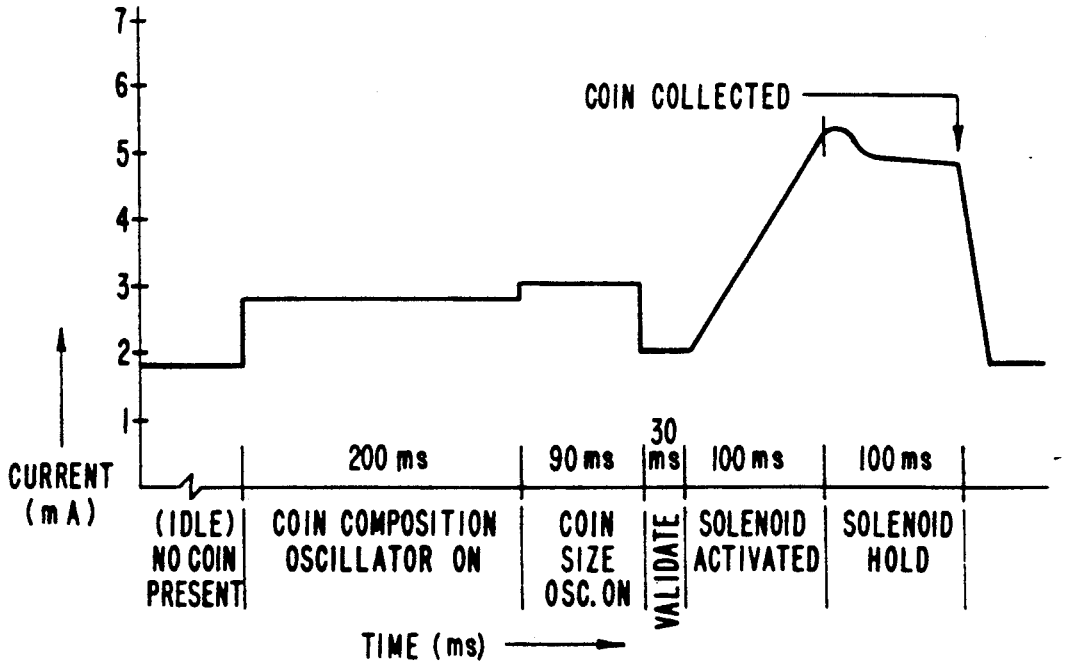
FIG. 6 is a graph which illustrates electric current usage of the electronic coin chute as a function of time.

The sequence of operations, and associated time intervals, are shown in FIG. 6 to illustrate the careful management of electric current during the validation process. The times shown in this drawing are representative of a 10-cent coin. Greater detail of the validation process is set forth in FIG. 7–11 which provide flow charts that illustrate, with particularity, the various operations of the processor.

In a typical ECC, the elapsed time between coin insertion and the event that the coin has passed the final coin quality sensor is approximately 350 milliseconds. This is a relatively short time interval to complete measurements of the pulse count (inversely related to the frequency) of the coin composition oscillator and the coin size oscillator as well as the calculation of acceptability limits. As has been previously indicated, certain measurements and calculations may be periodically made. In order to minimize the required speed for the processor, thus minimizing its cost and power consumption, measurements of ambient temperature and associated calculations may be made by the processor as it performs "background" tasks that take place when the coin chute is not in active use. Such measurements may be several minutes old without significantly affecting overall accuracy because environmental conditions change rather slowly. In the case of a public telephone, the processor is advantageously alerted that a coin is about to be inserted into the coin entry when the user activates the switchhook 401 (see FIG. 4). Switchhook mechanisms are well known in the telephone design art and typically include a number of switches, some being opened and others being closed upon activation. Processor 250 responds to one of these switches to commence certain measurements and calculations. Typically, a startup routine includes measurements of the idle frequency for the various oscillators to obtain benchmark readings indicative of an ambient condition, such as temperature, which is described in greater detail in application Ser. No. 368,619 filed on June 20, 1989.

Figure 7:
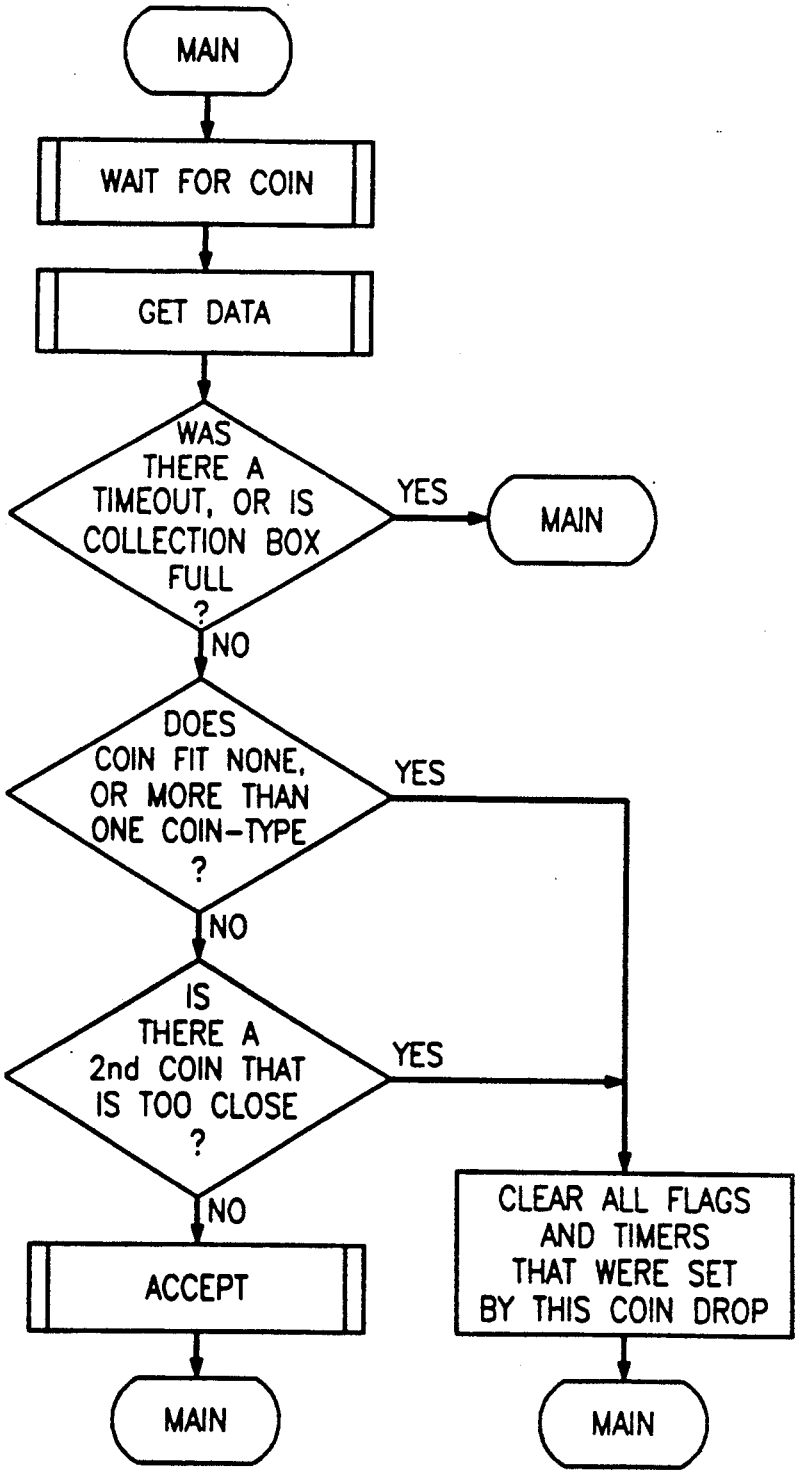
FIGS. 7–13 are flow charts that illustrate the operation of the processor used in the electronic coin chute, primarily with regard to power conservation during the coin validation process.
Figure 8:
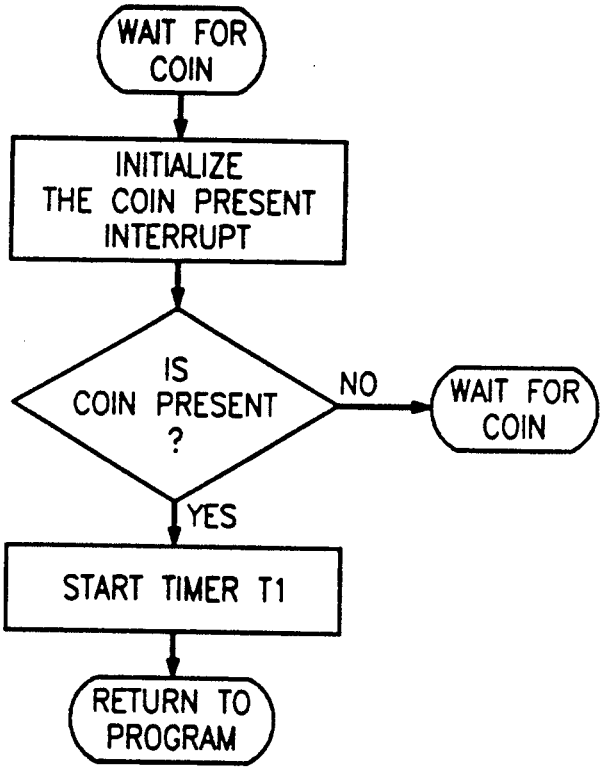

FIG. 7 discloses the Main program used in the present invention. The majority of time is spent in a subroutine which waits for a coin to be deposited and detected by the coin presence sensor 11 shown in FIG. 1. FIG. 8 discloses various steps in the "Wait For Coin" subroutine which principally comprises a loop that initializes the coin present interrupt. Once the presence of a coin has been detected, timer $T_1$ is started to make sure that the coin takes no longer than 500 milliseconds to get past the coin composition and coin size oscillators. A longer time indicates an unacceptable coin or fraudulent activity. The subroutine returns to the Main program which now calls for a "Get Data" subroutine to be executed.

Figure 10:
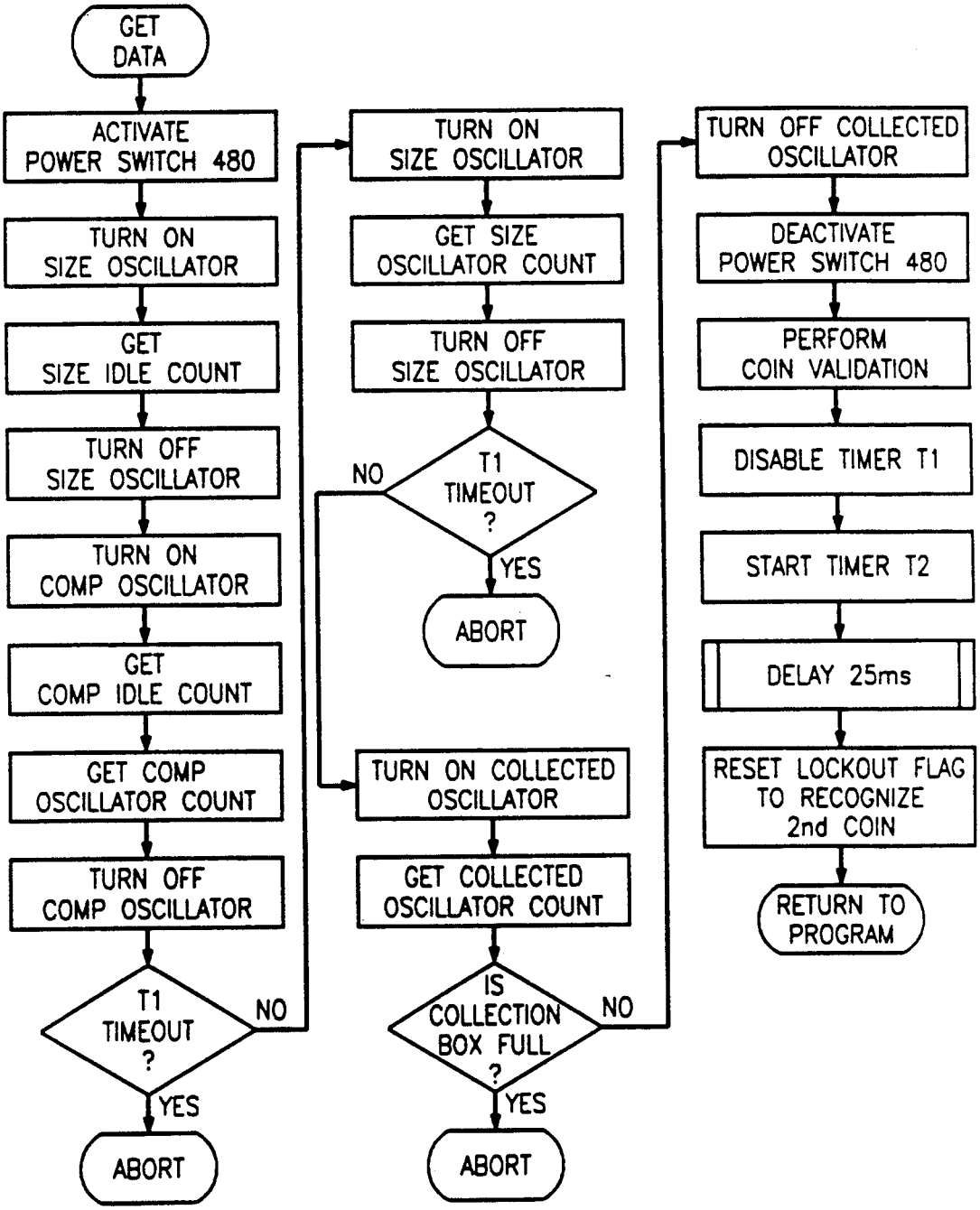
Figure 11:
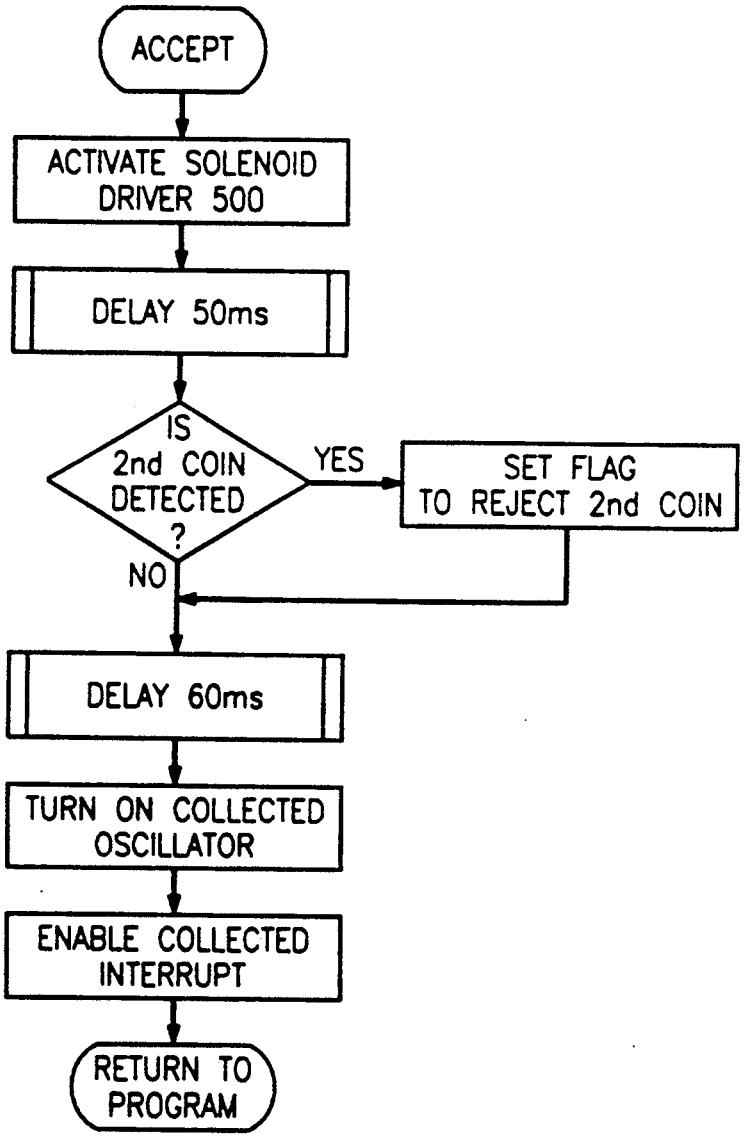

FIG. 10 sets forth the various steps in the Get Data subroutine. Power switch 480, described above, is now activated. It causes regulated +V volts to be applied to the counting circuits shown in block 400 of FIG. 4. At this time the coin has not reached either of the coin quality sensors and a measurement of their idle frequency can be made. Power is first applied to the coin size oscillator and the number of pulses of a 2.46 MHz oscillator that occur between N full cycles of the size oscillator (called the idle count of the size oscillator) is measured. The size oscillator is turned off to conserve power and the composition oscillator is turned on. A similar measurement of the number of pulses of the 2.46 MHz oscillator that occur between N full cycles of the composition oscillator (called the idle count of the composition oscillator) is measured. At this time, new acceptability limits for each of the coins may be calculated since the ambient temperature is reflected in the measurement of idle count of each coin quality oscillator. Power to the composition oscillator remains on until after the coin has actually passed-by and the pulse count has been measured. Multiplexer 410 (see FIG. 4) is adapted to deliver the output signal from the composition oscillator to buffer 300 when switch 411-2 is operated. At this time, counter 420 is set so that N=2. When the coin enters the oscillating magnetic field of the composition sensor, the pulse count decreases (i.e., the frequency increases). Processor 250 monitors the number of pulses of a 2.46 MHz source that are counted during each successive N cycles of the signal on lead 415. Four successively decreasing measurements of pulse count $C_V$ indicates that the coin is under the influence of the composition sensor. The minimum pulse count (maximum frequency) occurs when the coin is completely between the coils of the composition oscillator and its interaction with the magnetic field is greatest. This value of minimum pulse count is determined by replacing the pulse count stored in a minimum count register (for coin composition) with the most recent count whenever it is lower. Seven successively decreasing measurements of pulse count are required, while the coin is under the influence of the composition sensor, for the minimum pulse count to be considered valid. When the most recent pulse count exceeds the stored minimum count by five, the number stored in the minimum count register is the one used in the determination of authenticity and denomination of the coin based on composition. This unique event also causes power to be removed from the composition oscillator.

The $T_1$ timer is now checked to see if it has timed out, and if so, this subroutine is aborted because 500 milliseconds should not have elapsed yet. If the $T_1$ timer has not timed out, power is applied to the coin size oscillator for a similar pulse count measurement except that N is now set equal to 20. When the coin enters the oscillating magnetic field of the coin size sensor, the pulse count decreases (i.e., the frequency increases). Processor 250 monitors the number of pulses of a 2.46 MHz source that are counted during each successive N cycles of the signal on lead 415. Decreasing measurements of pulse count $C_V$ indicate that the coin is moving under the influence of the coin size sensor. The minimum pulse count (maximum frequency) occurs when the coin is completely between the coils of the size oscillator and its interaction with the magnetic field is greatest. Four successively decreasing measurements of pulse count $C_V$ indicates that the coin is under the influence of the size sensor. The minimum pulse count (maximum frequency) occurs when the coin is completely between the coils of the size oscillator and its interaction with the magnetic field is greatest. This value of minimum pulse count is determined by replacing the pulse count stored in a minimum count register (for coin size) with the most recent count whenever it is lower. Seven successively decreasing measurements of pulse count are required, while the coin is under the influence of the size sensor, for the minimum pulse count to be considered valid. When the most recent count is only four less than the previously measured idle count, $C_{IDLE}$, the coin is no longer deemed to be under the influence of the size sensor—an event that causes power to be removed from the size sensor. The number stored in the minimum count register is the one used in the determination of authenticity and denomination of the coin based on size. Thereafter, the $T_1$ timer is checked to see if it has timed out; if so, this subroutine is aborted because 500 milliseconds should not have elapsed yet. If the $T_1$ timer has not timed out, power is applied to the coin collected oscillator to determine whether coins have backed up into the chute; if so the frequency of the coin collected oscillator will change and this will be detected. This subroutine will abort when the collection box is full, otherwise power is removed from the coin collected oscillator and power switch 480 (see FIG. 4) is deactivated.

Processor 250 compares the stored minimum pulse counts for the size and composition oscillators with their recently-calculated, corresponding limit values. At the same time, timer $T_1$ is disabled and timer $T_2$ is started. $T_2$ runs for approximately 1 second. After a 25 millisecond delay, the lockout flag is reset to respond to the presence of a second coin being inserted into the chute and the Get Data subroutine is completed. Control is now returned to the Main program of FIG. 7.

The Main program is now at the step where it examines information returned from the Get Data subroutine. If there was a timeout or if the collection box was full, further steps are discontinued and the Main program starts all over again. Processor 250 now determines whether the just-measured values for size and composition matches none or more than one of the allowable coin types, or if there is a second coin that is too close to the first. Either event will cause all flags and timers to be reset without accepting the coin and the Main program starts over. If the measured parameters match exactly one coin-type and a second coin is not too close, the coin will be accepted in accordance with the "Accept" subroutine of FIG. 11.

During the Accept subroutine, solenoid driver 500 (see FIG. 5) is activated as discussed above. Thereafter, a 50 milliseconds delay is imposed and a determination is made as to whether a second coin has been inserted into the chute. If so, a flag is set to reject the second coin. Another delay is now imposed that is 60 milliseconds in duration, after which time power is applied to the coin collected oscillator and the coin collected interrupt is enabled. This subroutine is now ended and control is returned to the Main program which is now directed to start at the beginning.

Figure 9:
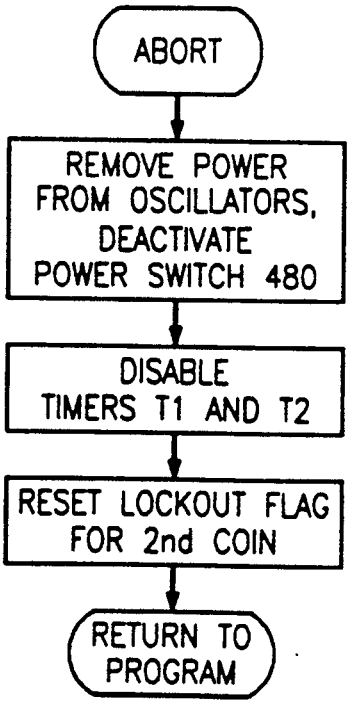

FIG. 9 discloses an "Abort" subroutine which starts by removing power from the size and composition oscillators as well as from the counting circuitry which is supplied by power switch 480. Timers $T_1$ and $T_2$ are disabled, the lockout flag for the second coin is reset and control is returned to the program that called for this subroutine.

Figure 12:
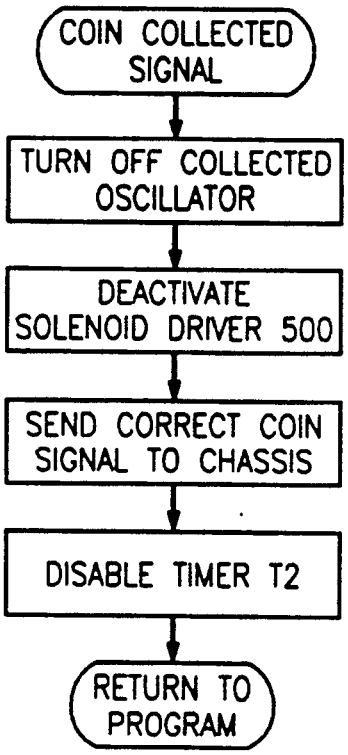

When the coin has been collected, an interrupt routine shown in FIG. 12 is called. At this time, the collected oscillator is turned-off and the solenoid driver 500 (FIG. 5) is deactivated. Information regarding the denomination of the coin that has just entered the collection box is now sent to the chassis, timer $T_2$ is disabled and control returns to the program that was in progress when this interrupt occurred.

Figure 13:
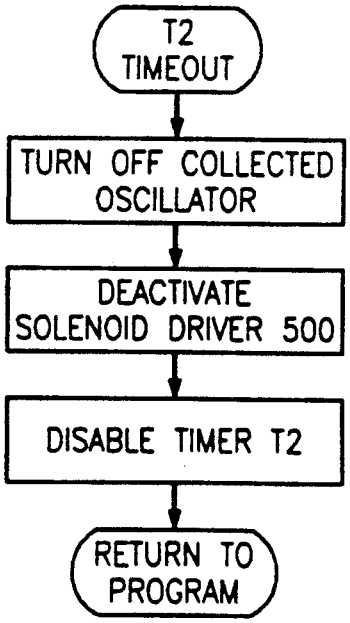

FIG. 13 shows the various steps that occur when timer $T_2$ times out. This is an interrupt that first causes the collected oscillator to turn-off and the solenoid driver 500 (FIG. 5) to be deactivated. $T_2$ is disabled and control returns to the program that was in progress when this interrupt occurred.

Various modifications are possible within the spirit of the present invention which include, but are not limited to, the use of sensor mechanisms other than oscillating magnetic fields to measure coin quality, or the use of coin routing apparatus that use power to reject, rather than accept, coins. The present invention may be applied to coin chutes that expect coins of a single denomination or coins of various denominations. Further, use of the invention together with a battery or other energy storage devices is possible without departing from the scope of the invention.

We claim:

1. An electronic coin chute (ECC) for examining coins for authenticity and denomination, the ECC including a coin path with an entry at one end thereof and an exit at the other, the ECC further including first and second sensors which are located along the coin path and which require electrical power to generate magnetic fields that interact with the coin, said first sensor being responsive to a first quality of the coin and to the location of the coin relative to the magnetic field to produce an output signal indicative of the degree of interaction between the coin and the magnetic field, said second sensor being responsive to a second quality of the coin and to the location of the coin relative to the magnetic field to produce an output signal indicative of the degree of interaction between the coin and the magnetic field, characterized by:

means for applying electrical power to the first sensor prior to the time when the coin enters its magnetic field;

means for removing electrical power from the first sensor and applying electrical power to the second sensor in response to a decrease in the degree of interaction between the coin and the magnetic field of the first sensor; and means for removing electrical power from the second sensor in response to a decrease in the degree of interaction between the coin and the magnetic field of the second sensor.

2. The ECC of claim 1 further characterized by:

a coin presence detector, responsive to the presence of coins for generating a coin present signal, the detector being positioned along the coin path between the coin entry and the first sensor; and means responsive to the coin present signal for applying power to the first sensor.

3. The ECC of claim 1 wherein the exit comprises coin routing apparatus for guiding acceptable coins to a first destination and non-acceptable coins to a second destination, the ECC further including means responsive to the output signals from the first and second sensors and to stored values corresponding to acceptable limits of said output signals, for determining the authenticity and denomination of each coin; and means for supplying a first predetermined amount of power to the coin routing apparatus in order to guide coins to one of said destinations, and for subsequently supplying a second predetermined amount of power to the coin routing apparatus, lesser than said first predetermined amount, to maintain the coin routing apparatus in this condition.

4. The ECC of claim 1 wherein the first and second sensors each include an oscillating magnetic field, each field oscillating at a different frequency, whereby two different qualities of each coin are examined.

5. The ECC of claim 4 wherein the frequency of each oscillating magnetic field departs from a predetermined idle frequency due to the interaction between the coin and the field, the frequency departure increasing as the coin moves toward the sensor and decreasing as the coin moves away from the sensor.

6. A method for examining coins for acceptability in an electronic coin chute (ECC) that includes a coin presence detector that detects when coins are inserted into the ECC, first and second coin quality sensors that each generate a magnetic field which interacts with the coin, the quality sensors producing an output signal in response to a first and second quality of the coin, the output signals indicating the degree of interaction between the coin and the magnetic fields, the ECC further including coin routing apparatus that diverts acceptable coins into a coin collecting apparatus, the method comprising the steps of:

applying electrical power to the first coin quality sensor when the coin presence detector detects that a coin has been inserted into the ECC;

measuring the interaction between the coin and the magnetic field of the first coin quality sensor;

removing electrical power from the first coin quality sensor and applying electrical power to the second quality sensor in response to a decrease in the interaction between the coin and the magnetic field of the first sensor; and removing electrical power from the second quality sensor in response to a decrease in the interaction between the coin and the magnetic field of the second sensor.

7. The method of claim 6 further including the steps of:

comparing the measured interaction between the coin quality sensor and the coin with stored values corresponding to acceptable limits for the measured interaction;

applying electrical power to the coin routing apparatus when the in response to a favorable comparison between said measured interaction and the stored acceptability limits; and removing a portion of the electrical power applied to the coin routing apparatus after the coin routing apparatus has been operated.

* * * * *